US005176803A

United States Patent [19]

Barbuto et al.

[11] Patent Number: 5,176,803

[45] Date of Patent: Jan. 5, 1993

[54] METHOD FOR MAKING SMOOTH SUBSTRATE MANDRELS

[75] Inventors: Anthony Barbuto, Watervliet; Raymond C. Schnoor, Rotterdam; Andrew S. Holik, Schenectady, all of N.Y.

[73] Assignee: General Electric Company, Worthington, Ohio

[21] Appl. No.: 815,478

[22] Filed: Mar. 4, 1992

[51] Int. Cl.[5] ..... C25F 3/18; C25F 3/22; C25F 7/00

[52] U.S. Cl. ..... 204/129.1; 204/129.95; 204/237; 204/272; 204/292

[58] Field of Search ..... 204/129.1, 129.95, 272, 204/237, 292

[56] References Cited

U.S. PATENT DOCUMENTS

| | | | |
|---|---|---|---|
| 2,970,950 | 2/1961 | Bahmann | 204/272 X |
| 3,429,787 | 2/1969 | Weinreich | 204/272 X |
| 3,740,324 | 6/1973 | Lesher | 204/129.1 X |
| 4,246,088 | 1/1981 | Murphy et al. | 204/272 X |
| 4,690,737 | 9/1987 | Vishnitsky | 204/272 X |
| 5,002,649 | 3/1991 | Smith | 204/272 X |

*Primary Examiner*—Donald R. Valentine

[57] ABSTRACT

Broadly, the present invention is directed to a method for electropolishing elongate metal mandrels in an electrolytic cell, wherein the electropolished metal mandrels are ideally suited for growing CVD diamond thereon for making water jet nozzles and similar flow control devices. The method of the present invention comprises placing an elongate cylindrical mandrel in an electrolytic cell between a pair of centering caps. The cell comprises an elongate annular cylindrical electrode, which preferably is a cathode, and which has open ends in which said pair of centering caps are placed to center said mandrel within said cylindrical electrode. The cell further comprises an outlet and an inlet connected to a circulating source of electropolishing electrolyte. The mandrel and the cylindrical electrode are connected to a source of electrical power. This electrical power is applied to the mandrel and the cylindrical electrode to establish an electrolytic cell. Finally, the source of electropolishing electrolyte is circulated through the cylindrical electrode to electropolish the mandrel. Another aspect of the present invention comprises the electrolytic cell for electropolishing elongate metal mandrels. Such electrolytic cell comprises an elongate annular cylindrical electrode having open ends, and an outlet and an inlet; a pair of centering caps which are placed in said open ends and which caps are adapted to receive an elongate cylindrical mandrel to center said mandrel within said cylindrical electrode; a circulating source of electropolishing electrolyte which is in flow communication with said cylindrical electrode via its outlet and its inlet; and a source of elecrical power connected to said mandrel and connectable to said cylindrical electrode. Said mandrel is electropolished by applying electrical power to said mandrel and to said cylindrical electrode to establish an electrolytic cell, and circulating said source of electropolishing electrolyte through said cylindrical electrode to electropolish said mandrel.

16 Claims, 1 Drawing Sheet

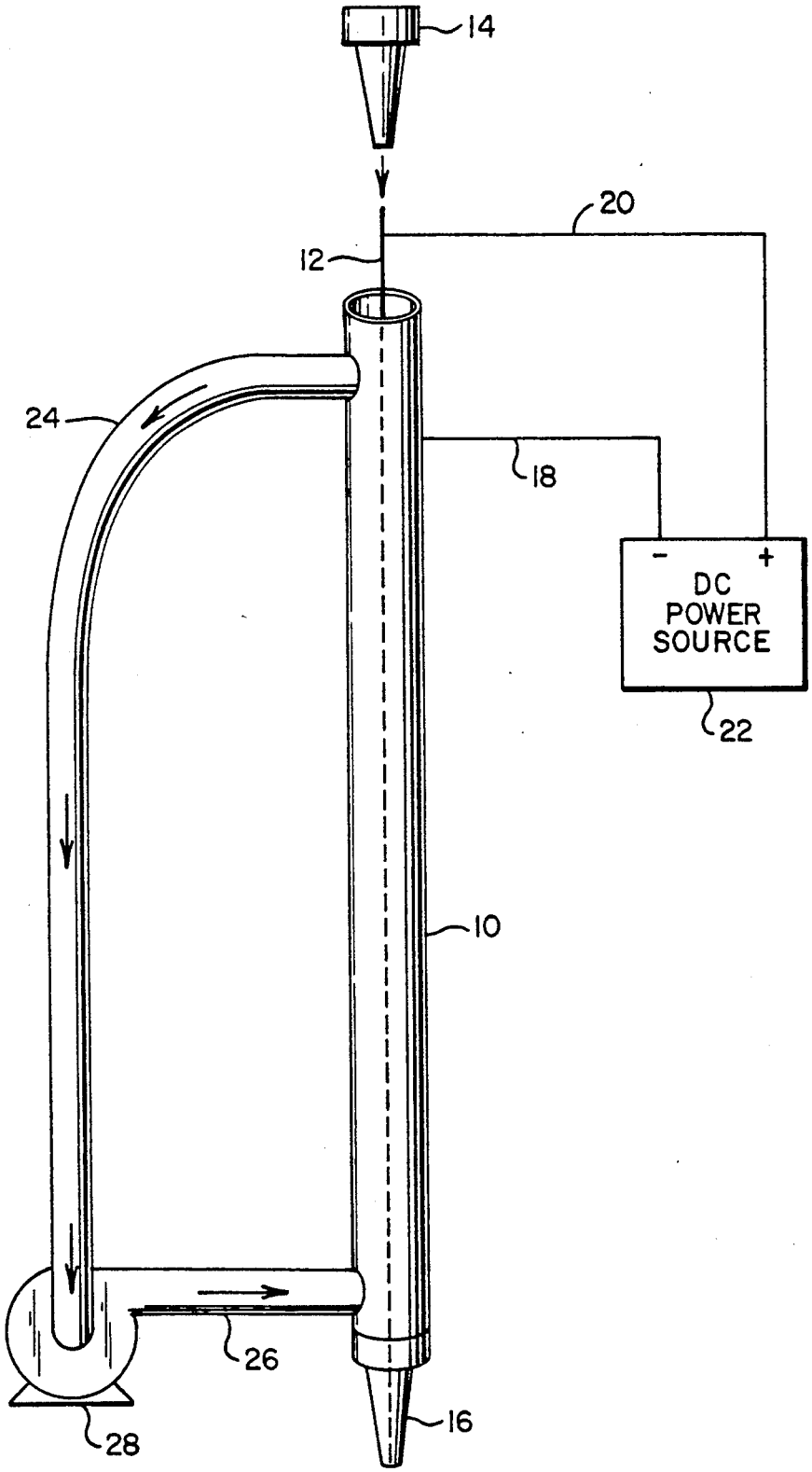
14
20
12
24
18
-
+
DC
POWER
SOURCE
22
10
26
28
16

METHOD FOR MAKING SMOOTH SUBSTRATE MANDRELS

BACKGROUND OF THE INVENTION

The present invention relates to annular components in which the annular interior surface is subjected to abrasive conditions during use and more particularly to a method for electropolishing mandrels used in making such CVD annulus components, such as water jet nozzles.

Its hardness and thermal properties are but two of the characteristics that make diamond useful in a variety of industrial components. Initially, natural diamond was used in a variety of abrasive applications. With the ability to synthesize diamond by high pressure/high temperature (HP/HT) techniques utilizing a catalyst/-sintering aid under conditions where diamond is the thermally stable carbon phase, a variety of additional products found favor in the marketplace. Polycrystalline diamond compacts, often supported on a tungsten carbide support in cylindrical or annular form, extended the product line for diamond additionally. However, the requirement of high pressure and high temperature has been a limitation in product configuration, for example.

Recently, industrial effort directed toward the growth of diamond at low pressures, where it is metastable, has increased dramatically. Although the ability to produce diamond by low-pressure synthesis techniques has been known for decades, drawbacks, including extremely low growth rates, prevented wide commercial acceptance. Recent developments have led to higher growth rates, thus spurring industrial interest in the field anew. Additionally, the discovery of an entirely new class of solids, known as "diamond like" carbons and hydrocarbons, is an outgrowth of such recent work.

Low pressure growth of diamond has been dubbed "chemical vapor deposition" or "CVD" in the field. Two predominant CVD techniques have found favor in the literature. One of these techniques involves the use of a dilute mixture of hydrocarbon gas (typically methane) and hydrogen wherein the hydrocarbon content usually is varied from about 0.1% to 2.5% of the total volumetric flow. The gas is introduced via a quartz tube located just above a hot tungsten filament which is electrically heated to a temperature ranging from between about 1750° to 2150° C. The gas mixture disassociates at the filament surface and diamonds are condensed onto a heated substrate placed just below the hot tungsten filament. The substrate is held in a resistance heated boat (often molybdenum) and heated to a temperature in the region of about 500° to 1100° C.

The second technique involves the imposition of a plasma discharge to the foregoing filament process. The plasma discharge serves to increase the nucleation density, growth rate, and it is believed to enhance formation of diamond films as opposed to discrete diamond particles. Of the plasma systems that have been utilized in this area, there are three basic systems: one is a microwave plasma system, the second is an RF (inductively or capacitively coupled) plasma system, and the third is a d.c. plasma system. The RF and microwave plasma systems utilize relatively complex and expensive equipment which usually requires complex tuning or matching networks to electrically couple electrical energy to the generated plasma. Additionally, the diamond growth rate offered by these two systems can be quite modest.

Despite the significant advances reported in the CVD art, one problem has plagued most of these processes—adhesion of the diamond film to the substrate. It is not uncommon for the CVD diamond layer to spall from the substrate, especially upon cooling of the substrate. The difference in coefficient of thermal expansion between diamond and the substrate often leads to interlayer stresses that make spalling an inevitable result.

Broad Statement of the Invention

Broadly, the present invention is directed to a method for electropolishing elongate metal mandrels in an electrolytic cell, wherein the electropolished metal mandrels are ideally suited for growing CVD diamond thereon for making water jet nozzles and similar flow control devices. The method of the present invention comprises placing an elongate cylindrical mandrel in an electrolytic cell between a pair of centering caps. The cell comprises an elongate annular cylindrical electrode, which preferably is a cathode, and which has open ends in which said pair of centering caps are placed to center said mandrel within said cylindrical electrode. The cell further comprises an outlet and an inlet connected to a circulating source of electropolishing electrolyte. The mandrel and the cylindrical electrode are connected to a source of electrical power. This electrical power is applied to the mandrel and the cylindrical electrode to establish an electrolytic cell. Finally, the source of electropolishing electrolyte is circulated through the cylindrical electrode to electropolish the mandrel.

Another aspect of the present invention comprises the electrolytic cell for electropolishing elongate metal mandrels. Such electrolytic cell comprises an elongate annular cylindrical electrode having open ends, and an outlet and an inlet; a pair of centering caps which are placed in said open ends and which caps are adapted to receive an elongate cylindrical mandrel to center said mandrel within said cylindrical electrode; a circulating source of electropolishing electrolyte which is in flow communication with said cylindrical electrode via its outlet and its inlet; and a source of electrical power connected to said mandrel and connectable to said cylindrical electrode. Said mandrel is electropolished by applying electrical power to said mandrel and to said cylindrical electrode to establish an electrolytic cell, and circulating said source of electropolishing electrolyte through said cylindrical electrode to electropolish said mandrel.

Advantages of the present invention include the ability to produce uniformly smooth electropolished surfaces on elongate metal rods. Another advantage is an electrolytic cell design which enables such uniform electropolishing to be accomplished by actually centering the elongate rod mandrel equidistant from the cathode cell interior surface. Yet another advantage is the ability to produce smooth elongate mandrels which are ideally suited for growing annular CVD diamond components, such as water jet nozzles thereon. These and other advantages will be readily apparent to those skilled in the art based upon the disclosure contained herein.

BRIEF DESCRIPTION OF THE DRAWING

The drawing is a side elevational view of the electrolytic cell used for electropolishing elongate metal mandrels. The drawing will be described in detail in connection with the following description.

DETAILED DESCRIPTION OF THE INVENTION

When stock molybdenum rods are used for growing CVD diamond layers thereon, the resulting annular components, when used as water jet nozzles, exhibit inside walls which are rough and not smooth, resulting in poor cutting performance. Specifically, the water jet produced by rough-walled nozzles prematurely breaks ups. Present day sapphire water jet nozzles have about two hours lifetime prior to being removed from use due to degradation in performance. The ability to provide uniform, smooth interior walls of CVD annular components, however, would enable production of CVD diamond nozzles having a lifetime of about 200 hours. Finally, rough walls on the interior of CVD diamond nozzles causes premature Rayleigh instability in the water flow resulting in a non-uniform, divergent water jet which has poor cutting capability.

The specially constructed electrolytic cell of the drawing can be used for electropolishing mandrels, such as molybdenum rod mandrels, which then can be used for growing CVD diamond annular components thereon. In particular, stainless steel cylinder 10 preferably serves as the cathode. For rod mandrel 12 constructed from, for example, molybdenum, having a diameter of 0.020 or 0.040 inch, cylinder 10 suitably can be about 12 inches long with a 0.375 inch inside diameter and a 0.5 inch outside diameter. Rod mandrel 12 is actually centered in cylinder 10 by end caps 14 and 16 which fit within the open ends of cylinder 10. The conical end of caps 14 and 16 are apertured for mandrel rod 12 to penetrate and, thus, accomplish its axial centering within cylinder 10.

Cylinder 10 suitably serves as the cathode while rod mandrel 12 serves as the anode in order to establish an electrolytic cell within cylinder 10. Accordingly, cylinder 10 and rod 12 are connected via lines 18 and 20, respectively, to electrical power source 22 which suitably is a d.c. power source used in the electrolytic cell art.

At the upper end of cylinder 10 is an outlet which is connected to rubber tubing 24. At the lower end of cylinder 10 is a similar outlet which is connected to rubber tubing 26. Rubber tubing (preferably, Neoprene® or a similar material) lines 24 and 26, in turn, are connected to electrolyte recirculating pump 28 which, in the drawing, is configured for pumping fluid into the bottom of cylinder 10 via line 26, up the length of cylinder 10, and thence out cylinder 10 via line 24.

An electropolishing electrolyte is housed within cylinder 10 for continuously being pumped by pump 28. The electrolyte, which suitably can consist of a solution of, for example, 13 parts by volume of sulfuric acid and 87 parts by volume of methanol, is pumped through cathode cylinder 10 during the electropolishing process. Agitation of the electrolyte caused by the flow promotes uniform electropolishing of mandrel rod 12. The flow rate of the electrolyte suitably can be about 10 ml/sec. Typical electrolytic conditions for proper electropolishing with the electrolytic cell described are as follows: 10 amps for 12 seconds for the 0.020 inch diameter mandrel and 15 amps for 20 seconds for the 0.040 inch diameter mandrel.

With respect to conventional CVD processes useful in making annular diamond components using the electropolished mandrels electropolished in accordance with the present invention, hydrocarbon/hydrogen gaseous mixtures are fed into a CVD reactor as an initial step. Hydrocarbon sources can include the methane series gases, e.g. methane, ethane, propane; unsaturated hydrocarbons, e.g. ethylene, acetylene, cyclohexene, and benzene; and the like. Methane, however, is preferred. The molar ratio of hydrocarbon to hydrogen broadly ranges from about 1:10 to about 1:1,000 with about 1:100 being preferred. This gaseous mixture optionally may be diluted with an inert gas, e.g. argon. The gaseous mixture is at least partially decomposed thermally by one of several techniques known in the art. One of these techniques involves the use of a hot filament which normally is formed of tungsten, molybdenum, tantalum, or alloys thereof. U.S. Pat. No. 4,707,384 illustrates this process.

The gaseous mixture partial decomposition also can be conducted with the assistance of d.c. discharge or radio frequency electromagnetic radiation to generate a plasma, such as proposed in U.S. Pat. Nos. 4,749,587, 4,767,608, and 4,830,702; and U.S. Pat. No., 434,188 with respect to use of microwaves. The substrate may be bombarded with electrons during the CVD deposition process in accordance with U.S. Pat. No. 4,740,263.

Regardless of the particular method used in generating the partially decomposed gaseous mixture, the substrate is maintained at an elevated CVD diamond-forming temperature which typically ranges from about 500° to 1100° C. and preferably in the range of about 850° to 950° C. where diamond growth is at its highest rate in order to minimize grain size.

Pressures in the range of from about 0.01 to 1000 Torr, advantageously about 100–800 Torr, are taught in the art, with reduced pressure being preferred. Details on CVD processes additionally can be reviewed by reference to Angus, et al., "Low-Pressure, Metastable Growth of Diamond and 'Diamondlike Phases', *Science*, vol. 241, pages 913–921 (Aug. 19, 5 1988); and Bachmann, et al., "Diamond Thin Films", *Chemical and Engineering News*, pp. 24–39 (May 15, 1989), the disclosures of which are expressly incorporated herein by reference.

With respect to the diamond annulus, it will be appreciated that the materials of construction necessarily must be stable at the elevated CVD diamond forming temperatures required by the CVD processing employed. Accordingly, appropriate substrates include, for example, metals (e.g. tungsten, molybdenum, silicon, and platinum), alloys, ceramics (e.g. silicon carbide, boron nitride, aluminum nitride), glasses, and carbon. It will be appreciated that the coefficient of thermal expansion of the annular substrate also should not be drastically higher than that of diamond in order to minimize the risk of fracturing the diamond layer deposited during the CVD processing. Because of the high temperatures involved during the CVD processing, it is believed that most stable annular substrates will have an appropriate coefficient of thermal expansion for implementation of the process. In this regard, it will be appreciated that the CVD diamond layer thickness laid down often will range from about 1 to 50 micrometers with about 10 to 20 micrometers being typical.

During the CVD processing, diamond growth occurs not only on the exposed surfaces, but also down the holes and along concave surfaces which may constitute the flow control unit. The gaseous mixture can be directed for selective growth/deposition of diamond only at desired locations of workpieces. When sufficient deposition has transpired, diamond growth is terminated by reducing the substrate temperature to ambient. This results in stresses between the diamond layer and the substrate since the thermal expansion coefficient of diamond is much less than that of metal or other annular substrate material. Often, the diamond coating will spontaneously spall from the surface; however, the diamond structure inside holes or other concave surfaces develops compressive forces so that the structure actually is strengthened by contraction, and therefore remains intact. This region often constitutes the zone of greatest wear since the greatest jet velocity and pressure-drop occurs here. Since diamond is the hardest known substance, this is precisely the region where diamond coverage is most desirable. These same comments hold true when an annular wire drawing die, for example, is being formed.

Further in this regard, diamond-coated nozzles most likely will find applications where wear is most critical. Wear can include tribiological processes, chemical processes, or a combination thereof. However, the present invention should not be exclusively limited to spraying systems, but readily can be extended to any flow control component including nozzles, feed throughs, flow valves, extrusion die liners, pressing mold liners, sand blast liners, injection liners, and the like.

It will be appreciated that certain modifications can be made to the present invention within the spirit and precepts disclosed herein, and such modifications are included in the disclosure and claims that follow. Also, all citations referenced herein are expressly incorporated herein by reference.

We claim:

1. A method for electropolishing elongate metal mandrels in an electrolytic cell, which comprises the steps of:

(a) placing an elongate cylindrical mandrel in an electrolytic cell between a pair of centering caps; said cell comprising an elongate annular cylindrical electrode having open ends in which said pair of centering caps are placed to center said mandrel within said cylindrical electrode, and an outlet and an inlet connected to a circulating source of electropolishing electrolyte; said mandrel and said cylindrical electrode connected to a source of electrical power;

(b) applying said electrical power to said mandrel and said cylindrical electrode to establish an electrolytic cell; and (c) circulating said source of electropolishing electrolyte through said cylindrical electrode to electropolish said mandrel.

2. The method of claim 1 wherein said mandrel is made from a material selected from tungsten, molybdenum, silicon, platinum, and alloys thereof; silicon carbide, boron nitride, aluminum nitride, carbon, or a glass.

3. The method of claim 2 wherein said mandrel is made from Mo.

4. The method of claim 1 wherein said cylindrical electrode is made from a stainless steel.

5. The method of claim 1 wherein said cylindrical electrode comprises the cathode.

6. The method of claim 1 wherein said electropolishing electrolyte comprises a solution of sulfuric acid in methanol.

7. The method of claim 1 wherein said source of electrical power comprises a d.c. power source.

8. The method of claim 1 wherein said mandrel is with 0.020 or 0.040 in in diameter.

9. The method of claim 7 wherein said mandrel is made from Mo and is 0.020 or 0.040 in in diameter.

10. The method of claim 9 wherein said electropolishing electrolyte comprises a solution of sulfuric acid in methanol; and said d.c. power source generates 10 amps for said 0.020 in diameter mandrel and 15 amps for said 0.040 in diameter mandrel.

11. An electrolytic cell for electropolishing elongate metal mandrels which comprises:

(a) an elongate annular cylindrical electrode having open ends, and an outlet and an inlet;

(b) a pair of centering caps which are placed in said open ends and which caps are adapted to receive an elongate cylindrical mandrel to center said mandrel within said cylindrical electrode;

(c) a circulating source of electropolishing electrolyte which is in flow communication with said cylindrical electrode via its outlet and its inlet; and (d) a source of electrical power connected to said mandrel and connectable to said cylindrical electrode; whereby said mandrel is electropolished by applying electrical power to said mandrel and to said cylindrical electrode to establish an electrolytic cell, and circulating said source of electropolishing electrolyte through said cylindrical electrode to electropolish said mandrel.

12. The electrolytic cell of claim 11 wherein said mandrel is made from a material selected from tungsten, molybdenum, silicon, platinum, and alloys thereof; silicon carbide, boron nitride, aluminum nitride, carbon, or a glass.

13. The electrolytic cell of claim 12 wherein said mandrel is made from Mo.

14. The electrolytic cell of claim 11 wherein said cylindrical electrode is made from a stainless steel.

15. The electrolytic cell of claim 11 wherein said cylindrical electrode comprises the cathode.

16. The electrolytic cell of claim 11 wherein said source of electrical power comprises a d.c. power source.

* * * * *